US009604427B2

(12) United States Patent
Hsu

(10) Patent No.: US 9,604,427 B2
(45) Date of Patent: Mar. 28, 2017

(54) FIBER/PLASTIC SHEET PRODUCT CUTTING-FOLDING MACHINE

(71) Applicant: CHAN LI MACHINERY CO., LTD., Taoyuan (TW)

(72) Inventor: Chi Pin Hsu, Taoyuan (TW)

(73) Assignee: Chan Li Machinery Co., Ltd., Taoyuan (TW)

( * ) Notice: Subject to any disclaimer, the term of this patent is extended or adjusted under 35 U.S.C. 154(b) by 709 days.

(21) Appl. No.: 13/729,259

(22) Filed: Dec. 28, 2012

(65) Prior Publication Data

US 2013/0316888 A1 Nov. 28, 2013

(30) Foreign Application Priority Data

May 28, 2012 (TW) ..... 101119024 A

(51) Int. Cl.
*B31F 7/00* (2006.01)
*B26D 1/38* (2006.01)
*B26D 7/01* (2006.01)

(52) U.S. Cl.
CPC ..... *B31F 7/00* (2013.01); *B26D 1/385* (2013.01); *B26D 7/018* (2013.01)

(58) Field of Classification Search
CPC .. B31F 7/00; B26D 1/385; B26D 1/40; B26D 1/405; B26D 1/365; B26D 2001/0053; B65H 45/24
USPC ..... 493/360, 359, 405, 430, 435, 442, 353, 493/361, 365, 411, 424, 428, 433, 448; 270/5.02, 8, 9, 20.1, 21.1, 52.07, 52.09, 270/39.09, 39.01, 39.05
See application file for complete search history.

(56) References Cited

U.S. PATENT DOCUMENTS 3,845,682 A * 11/1974 Willhite ..... B26D 1/205 83/431
4,765,604 A * 8/1988 Trogan ..... 270/39.09
5,241,884 A * 9/1993 Smithe ..... B26D 5/20 226/195
5,363,728 A * 11/1994 Elsner ..... B26D 7/08 83/116
6,551,227 B1 * 4/2003 Whitten ..... B65H 35/08 493/356
7,458,927 B2 * 12/2008 Kauppila et al. ..... 493/435
(Continued)

FOREIGN PATENT DOCUMENTS

EP 1826165 B1 9/2009
TW 200922855 A 6/2009
WO WO 2011015893 A1 * 2/2011

*Primary Examiner* — Michelle Lopez
*Assistant Examiner* — Chinyere Rushing-Tucker
(74) *Attorney, Agent, or Firm* — Rosenberg, Klein & Lee

(57) ABSTRACT

A fiber/plastic sheet product cutting-folding machine composed of a cutter, a rotary cutting wheel, one or more differential wheels, a first folding wheel and a second folding wheel is disclosed. The cutter and the rotary cutting wheel are adapted to cut off a fiber/plastic sheet product passing therebetween so that each cut piece of fiber/plastic sheet product has a straight cut edge. The differential wheel enables each two successive cut pieces of fiber/plastic sheet product to be partially overlapped, forming a stack of interfold fiber/plastic sheet product. Subject to the application of the fiber/plastic sheet product cutting-folding machine, each stack of interfold fiber/plastic sheet product is kept neat.

6 Claims, 14 Drawing Sheets

(56) References Cited

U.S. PATENT DOCUMENTS

| | | | | |
|---|---|---|---|---|
| 2005/0070419 | A1* | 3/2005 | Haasl | 493/435 |
| 2006/0063657 | A1* | 3/2006 | St. Germain | B65H 20/02 493/418 |
| 2007/0082800 | A1* | 4/2007 | Kauppila | 493/427 |
| 2007/0203007 | A1 | 8/2007 | De Matteis | |
| 2009/0137375 | A1* | 5/2009 | Tsai | B31F 1/10 493/442 |
| 2009/0289407 | A1 | 11/2009 | De Matteis | |
| 2011/0230324 | A1 | 9/2011 | De Matteis | |
| 2012/0167736 | A1* | 7/2012 | Yokoe | B26D 1/405 83/348 |
| 2012/0202670 | A1* | 8/2012 | De Matteis | 493/405 |
| 2012/0245011 | A1* | 9/2012 | De Matteis | B26D 1/0006 493/360 |
| 2013/0029826 | A1* | 1/2013 | Richards | B41F 13/64 493/360 |
| 2015/0114197 | A1* | 4/2015 | Tsai | B26D 1/405 83/592 |

* cited by examiner

FIBER/PLASTIC SHEET PRODUCT CUTTING-FOLDING MACHINE

BACKGROUND OF THE INVENTION

1. Technical Field

The present invention relates to a cutting-folding machine and more particularly, to a fiber/plastic sheet product cutting-folding machine, which enhances the neatness of processed and folded fiber/plastic sheet products.

2. Description of the Prior Art

Referring to FIG. 1, a conventional fiber sheet product cutting-folding machine is shown. As illustrated, this conventional fiber sheet product cutting-folding machine 10 is adapted for cutting and folding fiber sheet products, comprising a cutting wheel 11, a rotary wheel 13, a differential wheel 15, a first folding wheel 171, and a second folding wheel 173.

The cutting wheel 11 and the rotary wheel 13 are disposed adjacent to each other and rotatable in reversed directions, for example, the cutting wheel 11 is rotatable in counter-clockwise direction and the rotary wheel 13 is rotatable in clockwise direction. The cutting wheel 11 has a plurality of cutters 111 attached thereto. The rotary wheel 13 has a plurality of open recesses 131 spaced around the periphery thereof. During rotation of the cutting wheel 11 and the rotary wheel 13, the cutters 111 of the cutting wheel 11 will coincide with the open recesses 131 of the rotary wheel 13, causing the cutters 111 of the cutting wheel 11 to cut through the fiber sheet product 12 at the open recesses 131, as shown in FIG. 1A. Each cutter 111 of the cutting wheel 11 has a serrated cutting edge, facilitating cutting through the fiber sheet product 12 at the corresponding open recess 131, and making a serrated edge on the fiber/plastic sheet product 22, as shown in FIG. 2A.

The differential wheel 15 is disposed adjacent to the rotary wheel 13 and the first folding wheel 171. The rotary wheel 13 receives the well-cut fiber sheet product 12 and transfers it to the first folding wheel 171 via the differential wheel 15, as shown in FIG. 1B and FIG. 1C. The differential wheel 15 and the first folding wheel 171 have different circumferences and different rotational speeds. Thus, during delivery of the well-cut fiber sheet product 12 from the differential wheel 15 to the first folding wheel 171, the rotational speed difference between the differential wheel 15 and the first folding wheel 171 causes the fiber sheet product 12 to be overlapped, as shown in FIG. 2B. In this embodiment, the rotational speed of the differential wheel 15 is greater than the rotational speed of the first folding wheel 171. The first folding wheel 171 and the second folding wheel 173 can further fold up the partially folded fiber sheet product 12, forming a common interfold fiber sheet product 12, as shown in FIG. 2C.

Using the aforesaid fiber sheet product cutting-folding machine 10 can cut and fold a fiber sheet product 12. However, this design of fiber sheet product cutting-folding machine 10 has drawbacks in actual application. As shown in FIG. 1A, when one cutter 111 cuts through the fiber sheet product 12 at one open recess 131, the cutter 111 imparts a pressure to the fiber sheet product 12, causing the fiber sheet product 12 to be stretched or moved out of place and leading to unequal fiber sheet product cut-piece length.

After cutting by one cutter 111, the cut end edge of the fiber sheet product 12 exhibits a serrated structure, causing a larger fiber sheet product cut-piece length tolerance. Variation in length or position between cut pieces of the fiber sheet product 12 or formation of the serrated structure on the end edge of the fiber sheet product 12 may cause the end edge of each cut piece of fiber sheet product 12 to be falsely folded, leading to an unequal thickness of folded stack of fiber sheet product, as shown in FIG. 2D, and complicating the follow-up packing process.

The first folding wheel 171 and the second folding wheel 173 each are equipped with at least one gripper 1711/1731 for gripping the fiber sheet product 12 to complete the folding of the fiber sheet product 12. The first folding wheel 171 is disposed adjacent to the differential wheel 15. To facilitate smooth rotation of the first folding wheel 171 and the differential wheel 15, the differential wheel 15 provides at least one open recess 151 at the periphery thereof corresponding to the at least one gripper 1711 so that the at least one open recess 151 can coincide with the at least one gripper 1711 during rotation of the first folding wheel 171 and the differential wheel 15, as shown in FIG. 1C. When the rotary wheel 13 is transferring the fiber sheet product 12 to the differential wheel 15, the fiber sheet product 12 is transferred by one open recess 131 of the rotary wheel 13 to one open recess 151 of the differential wheel 15, as shown in FIG. 1B. This transferring method cannot accurately and smoothly transfer the fiber sheet product 12, and the fiber sheet product 12 may be biased easily during transfer, resulting in poor neatness of the folded fiber sheet product 12.

SUMMARY OF THE PRESENT INVENTION

It is, therefore, an object of the present invention to provide a fiber/plastic sheet product cutting-folding machine, which uses a cutter and a rotary cutting wheel to cut off a fiber/plastic sheet product, so that each cut piece of fiber/plastic sheet product has a straight cut edge, facilitating stacking of cut pieces of fiber/plastic sheet product neatly in an interfolded form.

It is another object of the present invention to provide a fiber/plastic sheet product cutting-folding machine, which has open recesses and/or protruding portions provided at the periphery of each wheel component thereof in such a manner that the open recesses and/or protruding portions of one wheel component can coincide with the protruding portions and/or open recesses of each adjacent wheel component during rotation, preventing displacement of each cut piece of fiber/plastic sheet product during transfer and facilitating follow-up cutting process, overlapping process and/or folding process.

It is still another object of the present invention to provide a fiber/plastic sheet product cutting-folding machine, which has at least one suction unit provided at each wheel component thereof for sucking each cut piece of fiber/plastic sheet product, so that each cut piece of fiber/plastic product can be held at each wheel component or transferred from one wheel component to another positively, enhancing machine operating efficiency.

To achieve these and other objects of the present invention, the present invention provides a fiber/plastic sheet product cutting-folding machine operable to cut and fold a predetermined fiber/plastic sheet product, comprising: a cutter; a rotary cutting wheel disposed adjacent to the cutter, the rotary cutting wheel comprising at least one cutting tool for touching the cutter to cut off the fiber/plastic sheet product during rotation of the rotary cutting wheel relative to the cutter; one or more differential wheels disposed adjacent to the rotary cutting wheel for receiving each cut piece of the fiber/plastic sheet product from the rotary cutting wheel and enabling each two successive cut pieces of the fiber/plastic sheet product to be overlapped; a first folding wheel disposed adjacent to the differential wheel for receiving each cut piece of the fiber/plastic sheet product from the differential wheel; and a second folding wheel disposed adjacent to the first folding wheel and rotatable relative to the first folding wheel to fold each cut piece of the fiber/plastic sheet product between the first folding wheel and the second folding wheel.

In one embodiment of the fiber/plastic sheet product cutting-folding machine, wherein the differential wheels comprises a first differential wheel and a second differential wheel disposed adjacent to each other, the second differential wheel being disposed between the first differential wheel and the first folding wheel.

In one embodiment of the fiber/plastic sheet product cutting-folding machine, wherein the rotational speed of the first differential wheel is greater than the rotational speed of the second differential wheel.

In one embodiment of the fiber/plastic sheet product cutting-folding machine, wherein the first differential wheel and the second differential wheel are so arranged that each two successive cut pieces of the fiber/plastic sheet product are partially overlapped at the second differential wheel.

In one embodiment of the fiber/plastic sheet product cutting-folding machine, wherein the circumference of the first differential wheel is greater than the circumference of the second differential wheel.

In one embodiment of the fiber/plastic sheet product cutting-folding machine, wherein the second differential wheel and the pressure wheel each comprise at least one protruding portion and at least one open recess disposed at the periphery thereof, the at least one protruding portion and at least one open recess of the second differential wheel being moved to coincide with the at least one open recess and at least one protruding portion of the pressure wheel to make at least one folding line on each cut piece of the fiber/plastic sheet product at the second differential wheel during relative rotation between the second differential wheel and the pressure wheel.

In one embodiment of the fiber/plastic sheet product cutting-folding machine, further comprising a pressure wheel disposed adjacent to the second differential wheel and adapted to impart a pressure to each cut piece of the fiber/plastic sheet product at the second differential wheel.

In one embodiment of the fiber/plastic sheet product cutting-folding machine, wherein the rotary cutting wheel, the first differential wheel, the second differential wheel, the first folding wheel and the second wheel each comprise at least one suction unit controllable to suck or release each cut piece of the fiber/plastic sheet product.

In one embodiment of the fiber/plastic sheet product cutting-folding machine, wherein the second differential wheel, the first folding wheel and the second folding wheel each comprise at least one protruding portion and at least one open recess adapted for transferring each cut piece of the fiber/plastic sheet product.

In one embodiment of the fiber/plastic sheet product cutting-folding machine, wherein the first differential wheel comprises at least one open recess adapted for receiving the at least one cutting tool of the rotary cutting wheel during relative rotation between the first differential wheel and the rotary cutting wheel.

DETAILED DESCRIPTION OF THE PREFERRED EMBODIMENTS

In the following description of the preferred embodiment of the present invention, it is to be noted that the word of "connection" means direct or indirect connection between or among objects or components, for example, an intermediate connecting member or multiple intermediate connecting members can be set between two or multiple objects or components.

Figure 3:
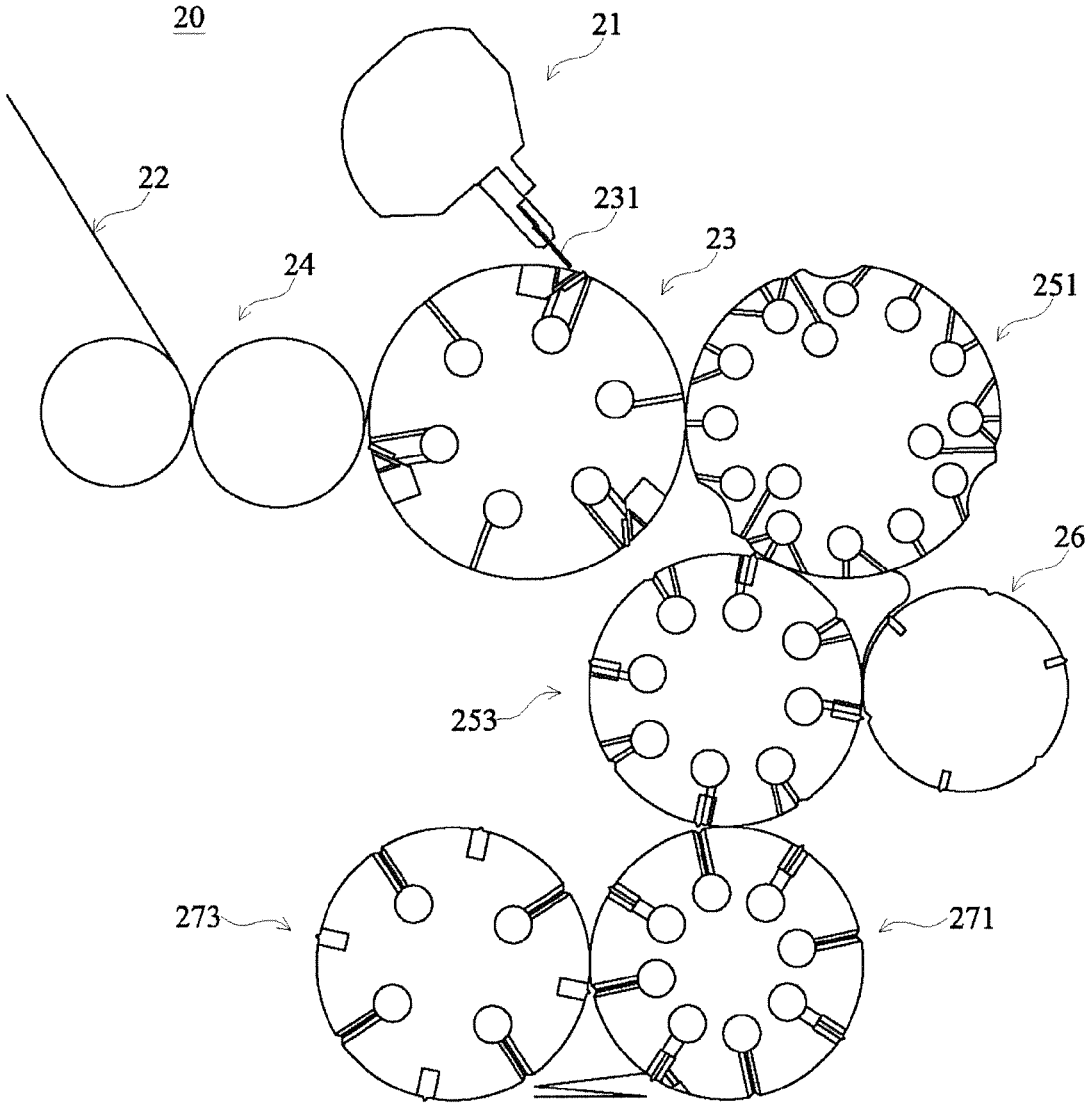
FIG. 3 is a schematic structural view of a fiber/plastic sheet product cutting-folding machine in accordance with the present invention.

Please refer to FIG. 3, a fiber/plastic sheet product cutting-folding machine in accordance with the present invention is shown. As illustrated, the fiber/plastic sheet product cutting-folding machine 20 is adapted for cutting and folding fiber/plastic sheet products 22, comprising a cutter 21, a rotary cutting wheel 23, at least one differential wheel 251, a first folding wheel 271 and a second folding wheel 273.

Figure 3A:
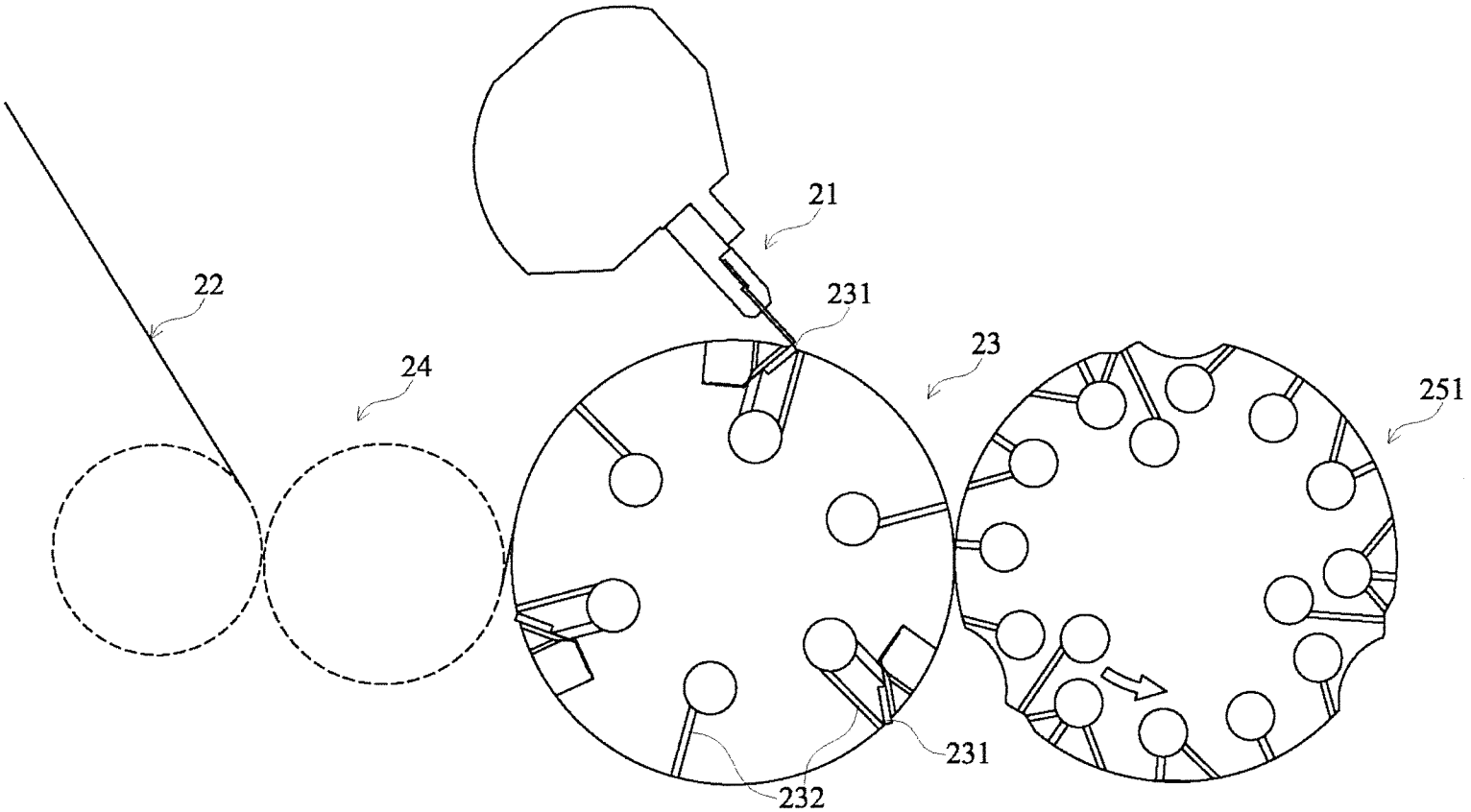
FIGS. 3A-3E are enlarged partial views of the fiber sheet product cutting-folding machine in accordance with the present invention.

Referring also to FIG. 3A, the cutter 21 and the rotary cutting wheel 23 are arranged adjacent to each other, and the rotary cutting wheel 23 is rotatable relative to the cutter 21. The cutter 21 can be a fixed cutter. The rotary cutting wheel 23 carries at least one cutting tool 231. During rotation of the rotary cutting wheel 23, each cutting tool 231 will touch the cutter 21 at a predetermined frequency to cut off a fiber/plastic sheet product 22 therebetween.

In one embodiment of the present invention, the fiber/plastic sheet product cutting-folding machine 20 further comprises at least one sheet transfer wheel set 24 adapted for transferring a fiber/plastic sheet product 22 to the rotary cutting wheel 23. The rotary cutting wheel 23 comprises at least one suction unit 232 adapted for sucking the transferring fiber/plastic sheet product 22 on the rotary cutting wheel 23. In different embodiments, the at least one sheet transfer wheel set 24 and/or the at least one suction unit 232 may be eliminated.

Figure 1:
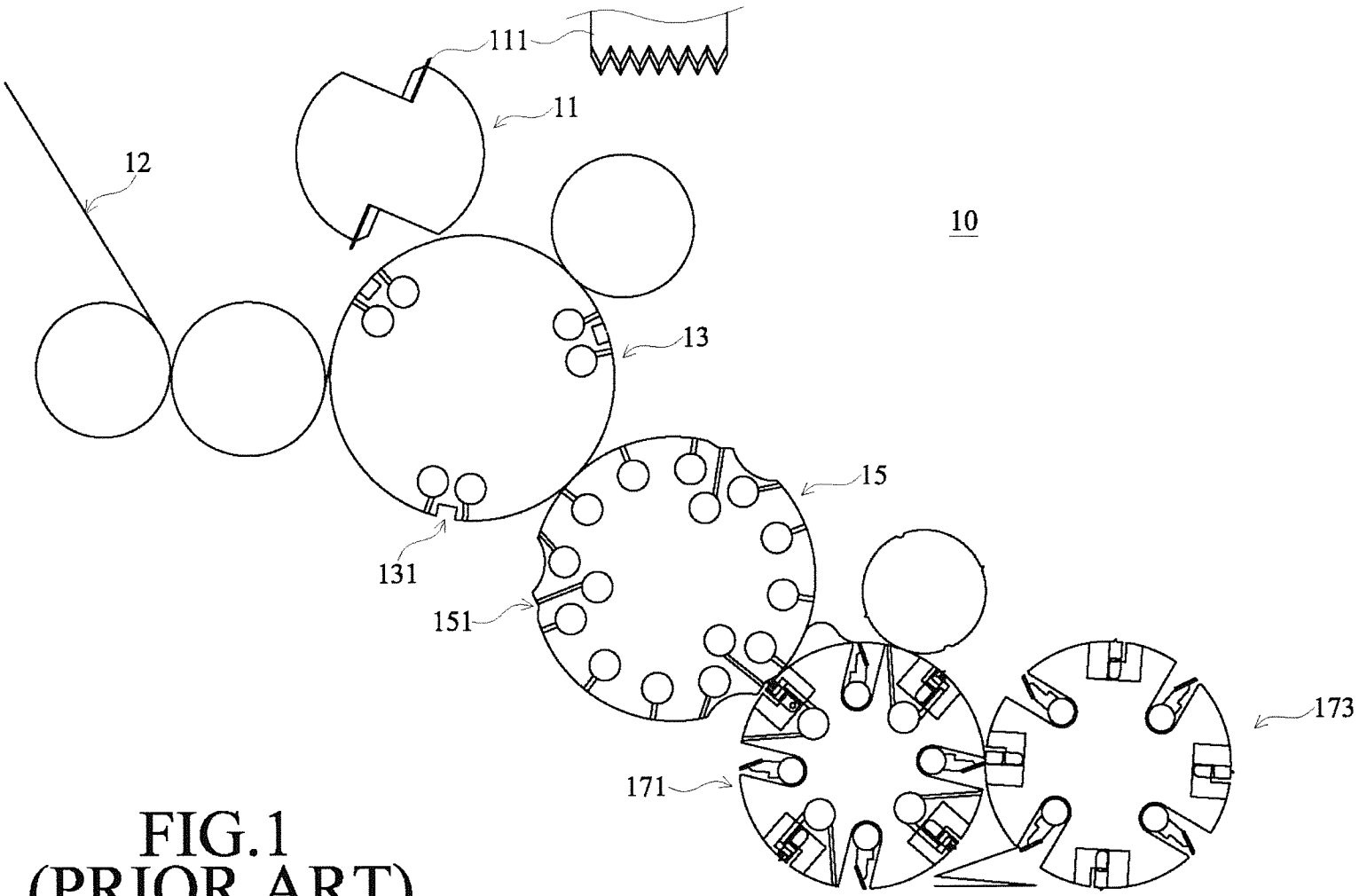
FIG.1 (PRIOR ART)
FIG. 1 is a schematic structural view of a fiber sheet product cutting-folding machine according to the prior art.
Figure 1A:
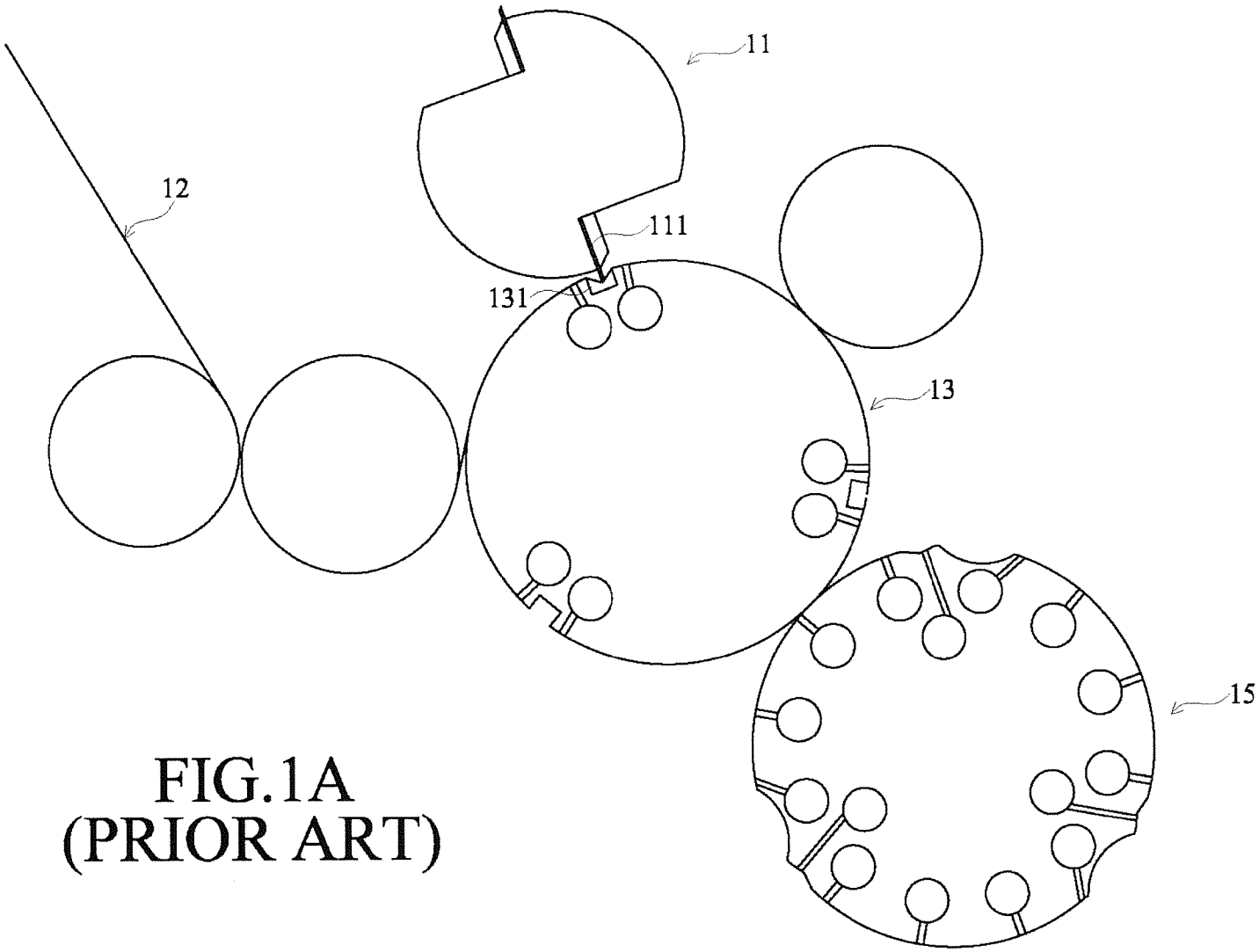
FIG.1A (PRIOR ART)
FIGS. 1A-1C are enlarged partial views of the fiber sheet product cutting-folding machine according to the prior art.
Figure 2A:
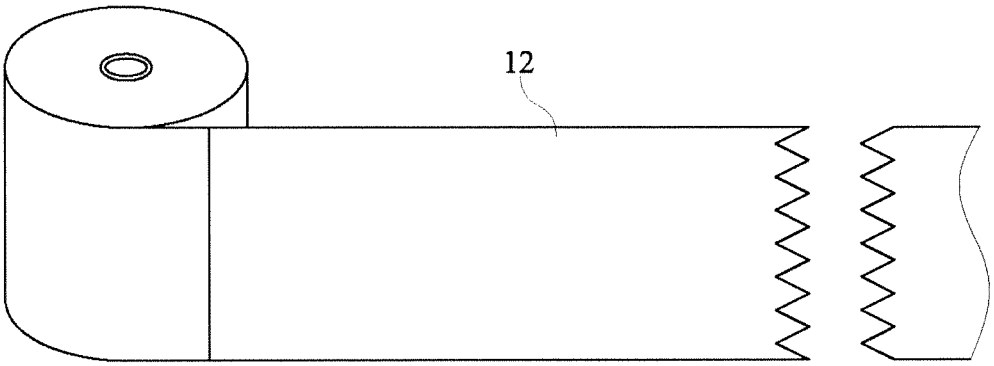
FIG.2A (PRIOR ART)
FIGS. 2A-2D are schematic drawings illustrating different status of a fiber sheet product processed through the fiber sheet product cutting-folding machine according to the prior art.
Figure 2B:
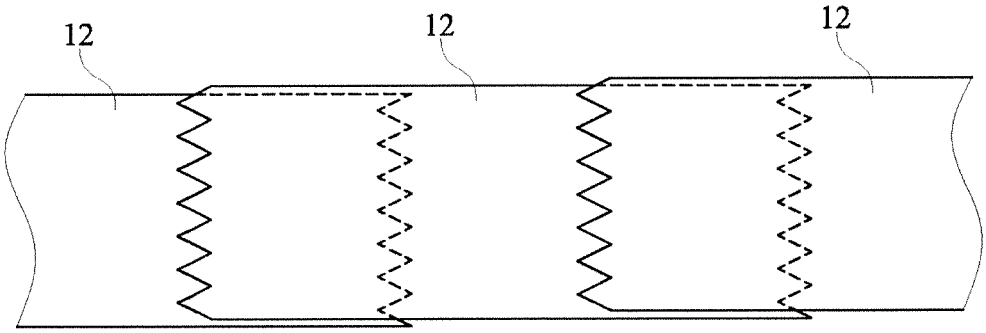
FIG.2B (PRIOR ART)
Figure 4A:
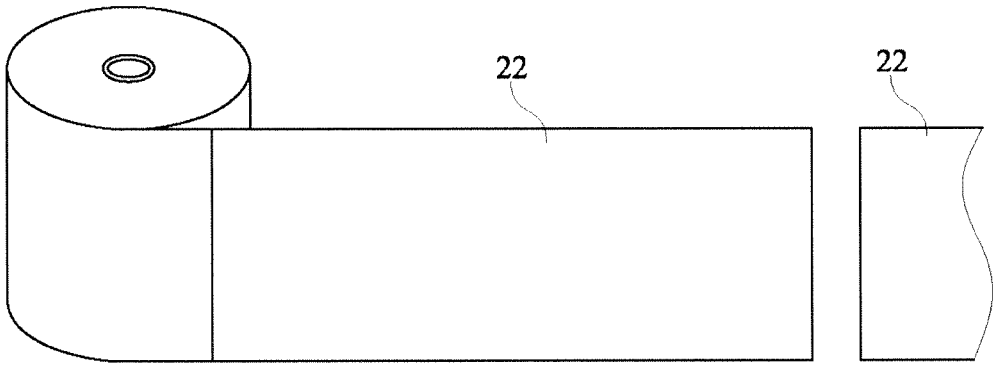
FIGS. 4A-4D are schematic drawings illustrating different status of a fiber sheet product processed through the fiber sheet product cutting-folding machine in accordance with the present invention.

The cutter 21 and each cutting tool 231 of the rotary cutting wheel 23 can be plain cutters without a serrated cutting edge. Thus, the cut edge of the fiber/plastic sheet product 22 is kept straight, as shown in FIG. 4A. Using the cutter 21 and the rotary cutting wheel 23 to cut off the fiber/plastic sheet product 22 avoids stretching of the fiber/plastic sheet product 22 (see the prior art problem shown in FIG. 1A) during cutting, or formation of a serrated edge on the fiber/plastic sheet product 22 (see the prior art problem shown in FIG. 2A). After cutting, all the processed fiber/plastic sheet products 22 are substantially similar in length and size, facilitating follow-up folding or stacking procedure.

Figure 1B:
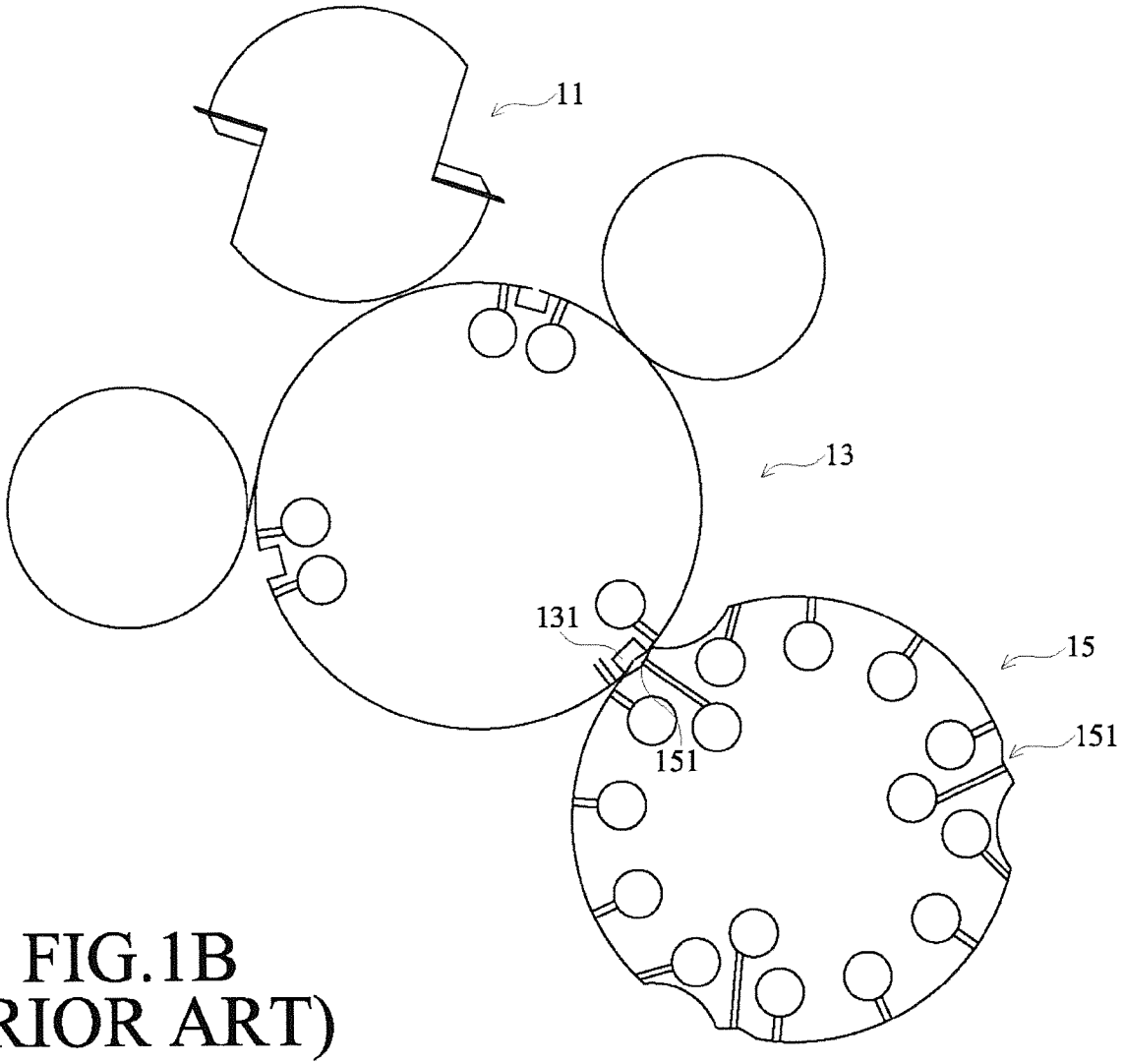
FIG.1B (PRIOR ART)
Figure 1C:
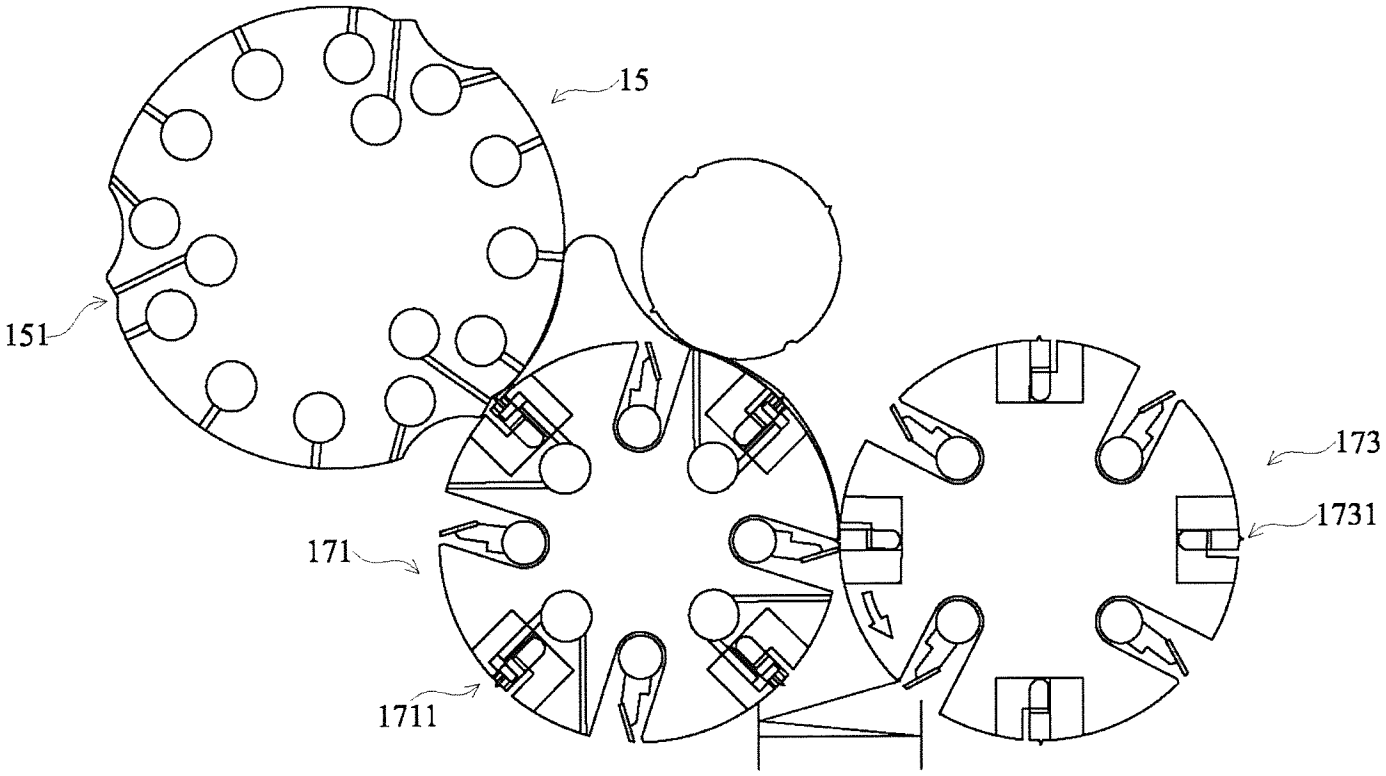
FIG.1C (PRIOR ART)
Figure 3B:
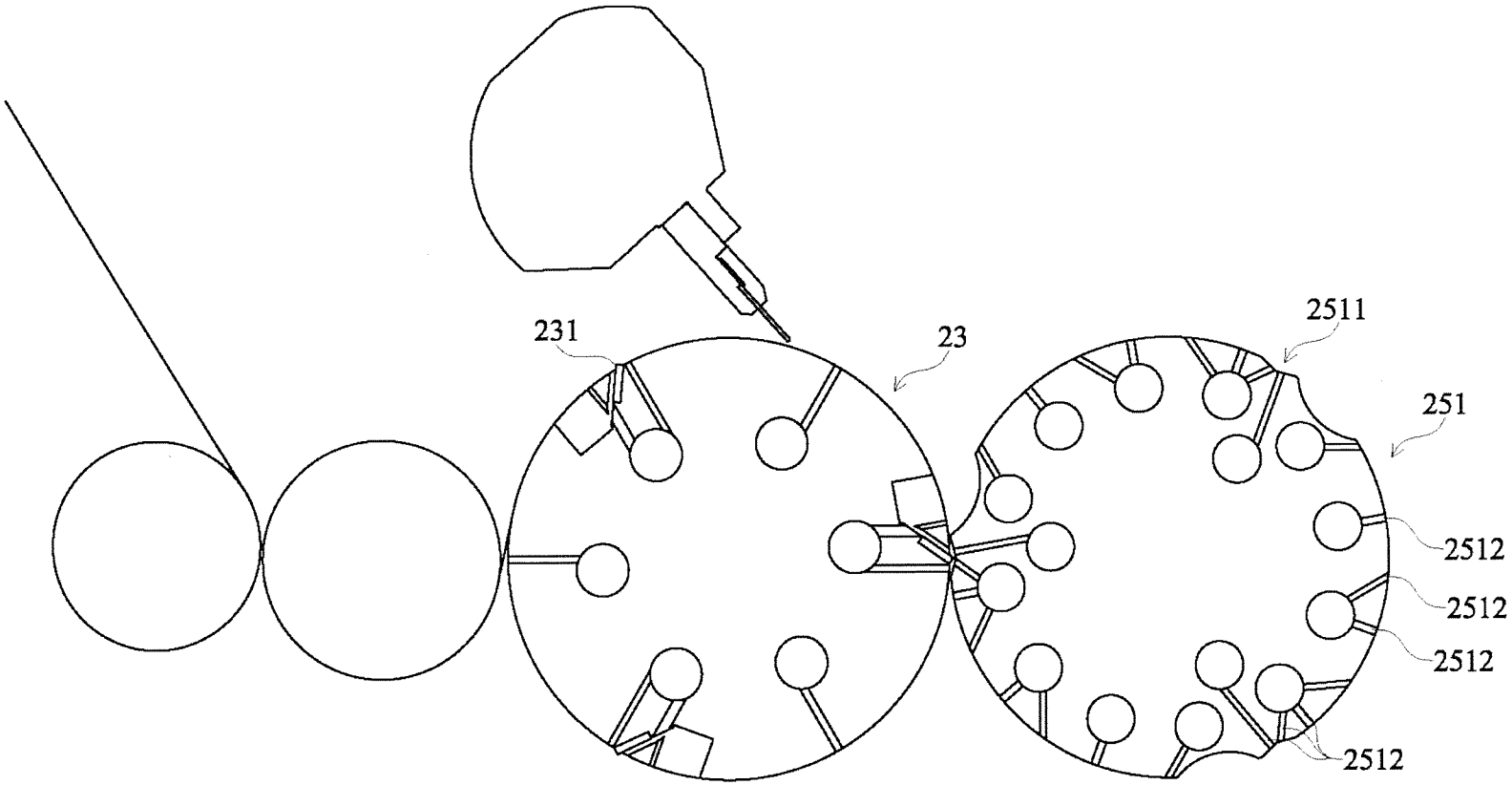

Referring also to FIG. 3B, the rotary cutting wheel 23 is disposed adjacent to a first differential wheel 251. After cutting, the fiber/plastic sheet product 22 is transferred by the rotary cutting wheel 23 to the first differential wheel 251. In this embodiment, each cutting tool 231 protrudes over the periphery of the rotary cutting wheel 23 and the first differential wheel 251 comprises at least one open recess 2511. During rotation of the rotary cutting wheel 23 and the first differential wheel 251, the cutting tools 231 of the rotary cutting wheel 23 will coincide with the open recesses 2511 of the first differential wheel 25, facilitating relative rotation between the rotary cutting wheel 23 and the first differential wheel 251. Further, each cut piece of fiber/plastic sheet product 22 can be transferred by one cutting tool 231 of the rotary cutting wheel 23 to one open recess 2511 of the first differential wheel 251, avoiding the problem seen in the prior art design shown in FIG. 1B and preventing displacement of the fiber/plastic sheet product 22 during transfer.

According to one embodiment of the present invention, the first differential wheel 251 comprises at least one suction unit 2512 adapted for sucking the cut piece of fiber/plastic sheet product 22 to hold it at the periphery of the first differential wheel 251. The at least one suction unit 2512 can be respectively mounted in the at least one open recess 2511 and controlled to suck the cut piece of fiber/plastic sheet product 22 at one cutting tool 231 of the rotary cutting wheel 23, enabling the cut piece of fiber/plastic sheet product 22 to be smoothly transferred by the rotary cutting wheel 23 to the first differential wheel 251.

Figure 3C:
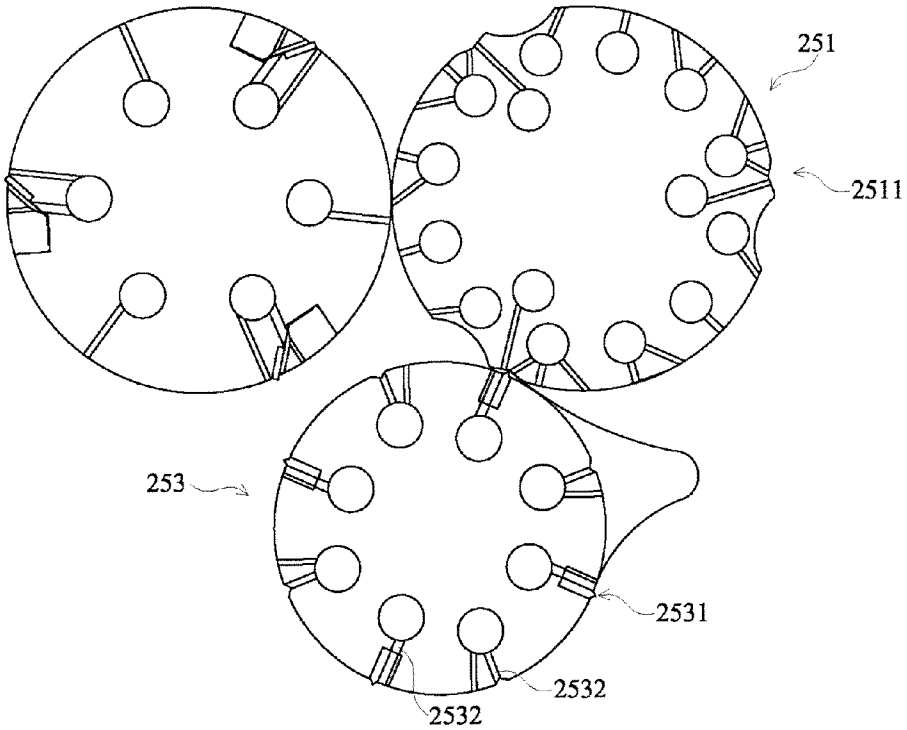

Referring also to FIG. 3C, the second differential wheel 253 is disposed adjacent to the first differential wheel 251 for receiving the cut piece of fiber/plastic sheet product 22 being transferred by the first differential wheel 251. According to one embodiment of the present invention, the second differential wheel 253 comprises at least one protruding portion 2531 corresponding to the at least one open recess 2511 of the first differential wheel 251. Thus, the at least one protruding portion 2531 can coincide with the at least one open recess 2511 during relative rotation between the second differential wheel 253 and the first differential wheel 251, facilitating smooth transfer of the cut piece of fiber/plastic sheet product 22 by the first differential wheel 251 to the second differential wheel 253, avoiding displacement of the cut piece of fiber/plastic sheet product 22 during transfer. In one embodiment of the present invention, a suction unit 2532 is provided at each protruding portion 2531 of the second differential wheel 252. During transfer of the cut piece of fiber/plastic sheet product 22 by one open recess 2511 of the first differential wheel 251 to one protruding portion 2531 of the second differential wheel 253, the respective suction unit 2532 sucks the cut piece of fiber/plastic sheet product 22.

Figure 3D:
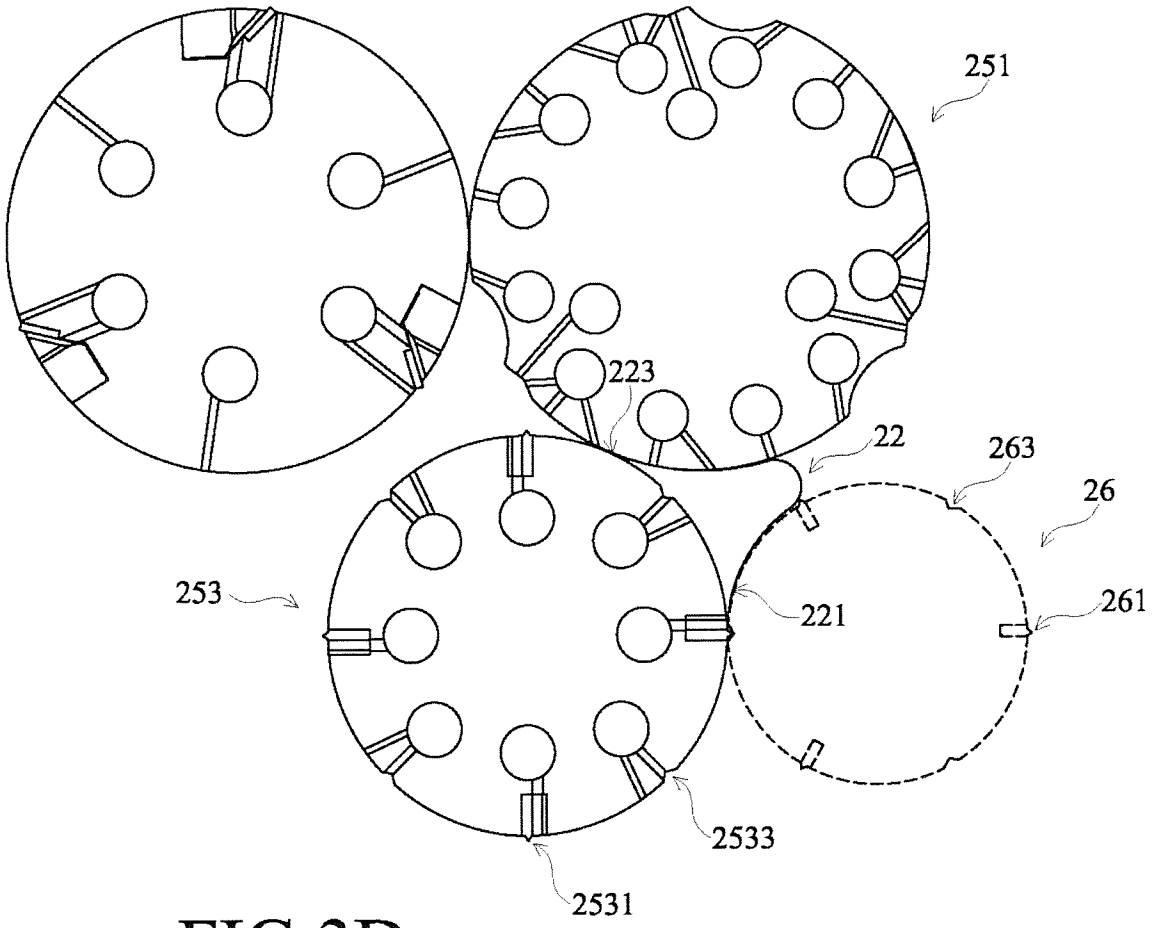

In one embodiment of the present invention, the fiber/plastic sheet product cutting-folding machine 20 further comprises a pressure wheel 26, as indicated by the imaginary line in FIG. 3D. The pressure wheel 26 is disposed adjacent to the second differential wheel 253, and adapted for pressing the cut piece of fiber/plastic sheet product 22 at the second differential wheel 253. The pressure wheel 26 can be configured to provide at least one protruding portion 261 and/or at least one open recess 263 corresponding to the at least one open recess 2533 and/or at least one protruding portion 2531 of the second differential wheel 253. Thus, the at least one protruding portion 261 and/or at least one open recess 263 of the pressure wheel 26 can coincide with the at least one open recess 2533 and/or at least one protruding portion 2531 of the second differential wheel 253 during relative rotation between the pressure wheel 26 and the second differential wheel 253. During relative rotation between the pressure wheel 26 and the second differential wheel 253, the at least one protruding portion 261 of the pressure wheel 26 and the at least one open recess 2533 of the second differential wheel 253 impart a pressure to the cut piece of fiber/plastic sheet product 22, making a folding line on the cut piece of fiber/plastic sheet product 22 at the second differential wheel 253, facilitating a follow-up step of folding the cut piece of fiber/plastic sheet product 22. In another embodiment of the present invention, the at least one open recess 263 of the pressure wheel 26 and the at least one protruding portion 2531 of the second differential wheel 253 can impart a pressure to the cut piece of fiber/plastic sheet product 22 to make a folding line on the cut piece of fiber/plastic sheet product 22.

Figure 4B:
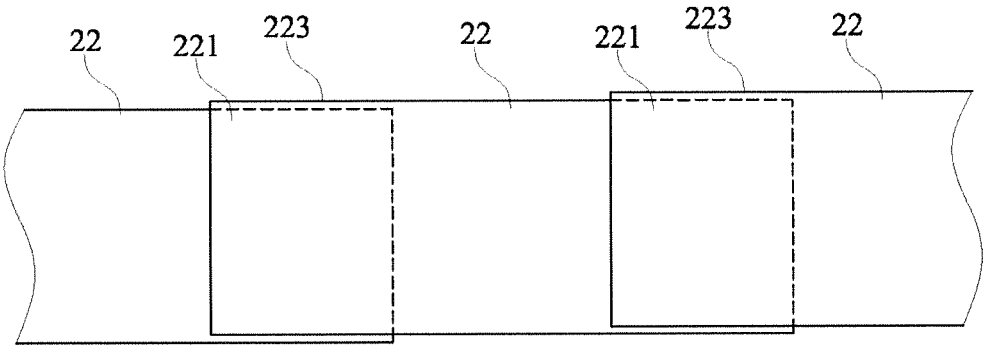

In one embodiment of the present invention, the first differential wheel 251 and the second differential wheel 253 have different rotational speeds and/or different circumferences. For example, the rotational speed of the first differential wheel 251 is greater than the rotational speed of the second differential wheel 253, and/or the circumference of the first differential wheel 251 is greater than the circumference of the second differential wheel 253. Because the first differential wheel 251 and the second differential wheel 253 have different rotational speeds and/or different circumferences, each two adjacent cut pieces of fiber/plastic sheet product 22 will be partially overlapped, as shown in FIG. 4B.

During transfer of one cut piece of fiber/plastic sheet product 22, the first differential wheel 251 transfers the lead end 221 of the cut piece of fiber/plastic sheet product 22 to the second differential wheel 253 firstly, while the tail end 223 of the cut piece of fiber/plastic sheet product 22 remains secured to the first differential wheel 251. In the case the rotational speed of the first differential wheel 251 is greater than the rotational speed of the second differential wheel 253, the tail end 223 of the cut piece of fiber/plastic sheet product 22 will be pushed by the first differential wheel 251, causing the cut piece of fiber/plastic sheet product 22 to curve outwards between the first differential wheel 251 and the second differential wheel 253. When the first differential wheel 251 transfers a next cut piece of fiber/plastic sheet product 22 to the second differential wheel 253, these two cut pieces of fiber/plastic sheet product 22 will be partially overlapped. For example, the first differential wheel 251 can release the tail end 223 of the cut piece of fiber/plastic sheet product 22 only after the lead end 221 of the next cut piece of fiber/plastic sheet product 22 has been transferred by the first differential wheel 251 to the second differential wheel 253, thus, the tail end 223 of the cut piece of fiber/plastic sheet product 22 can be overlapped by the lead end 221 of the next cut piece of fiber/plastic sheet product 22, as shown in FIG. 4B.

In actual application, adjusting the relative circumference and/or rotational speed between the first differential wheel 251 to the second differential wheel 253 can change the overlapped area between each two adjacent cut pieces of fiber/plastic sheet product 22.

To facilitate explanation, only two differential wheels, for example, the first differential wheel 251 and the second differential wheel 253 are shown in FIG. 3C. However, this arrangement is not a limitation. In actual application, the number of differential wheel can be 1. Simply using one single differential wheel still can let each two successive cut pieces of fiber/plastic sheet product 22 be partially overlapped. Further, in the embodiment shown in FIG. 3D, a pressure wheel 26 is provided. However, in actual application, this pressure wheel 26 can be eliminated, and the fiber/plastic sheet product cutting-folding machine 20 can also cut and fold the fiber/plastic sheet product 22.

Figure 3E:
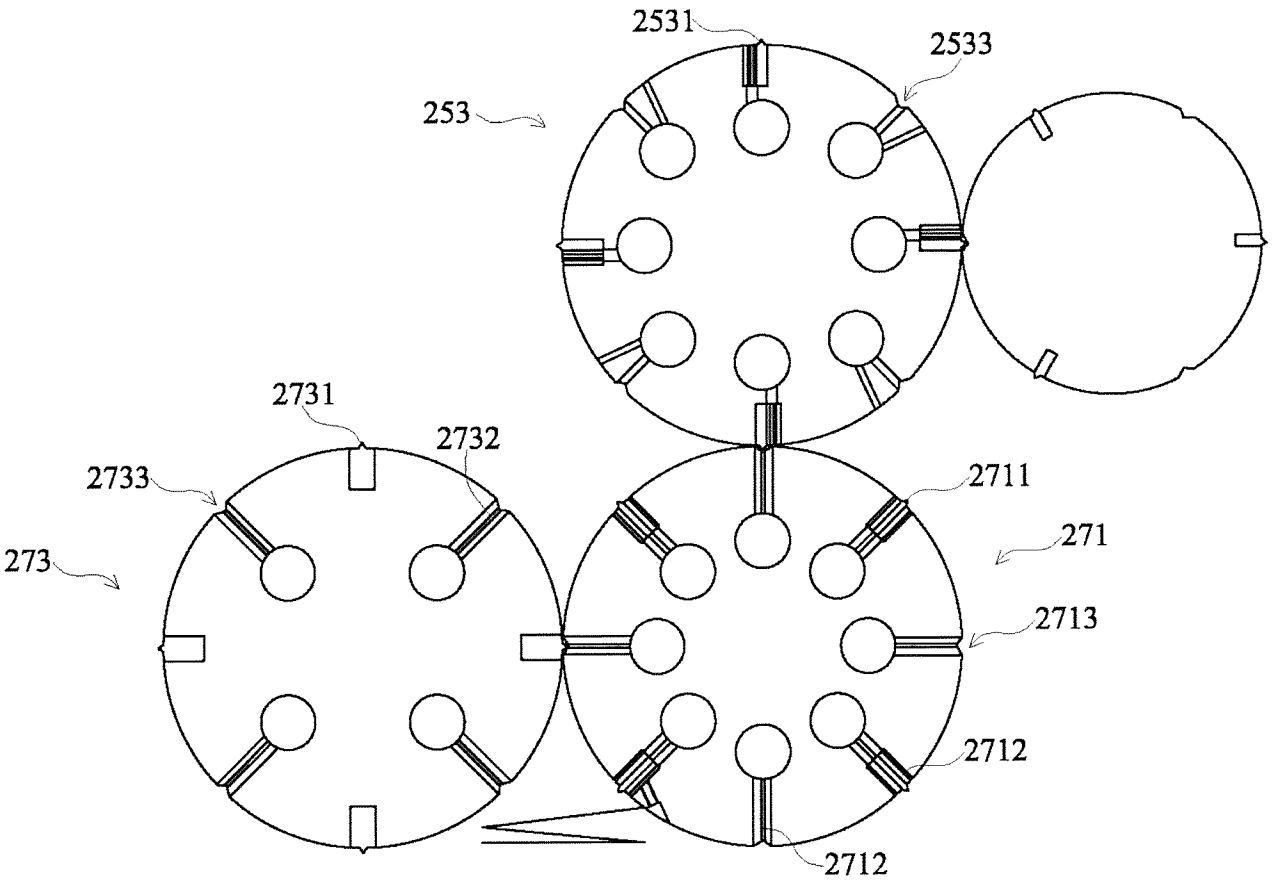

Referring also to FIG. 3E, the first folding wheel 271 is disposed adjacent to the second differential wheel 253, and adapted for receiving partially overlapped cut pieces of fiber/plastic sheet product 22 from the second differential wheel 253. Further, the second differential wheel 253 comprises at least one protruding portion 2531 and at least one open recess 2533 alternatively arranged around the periphery. The first folding wheel 271 comprises at least one protruding portion 2711 and at least one open recess 2713 alternatively arranged around the periphery corresponding to the at least one open recess 2533 and at least one protruding portion 2531 of the second differential wheel 253. Thus, the at least one protruding portion 2711 and at least one open recess 2713 of the first folding wheel 271 can coincide with the at least one open recess 2533 and at least one protruding portion 2531 of the second differential wheel 253 during relative rotation between the first folding wheel 271 and the second differential wheel 253, enabling the partially overlapped cut pieces of fiber/plastic sheet product 22 to be transferred by the at least one protruding portion 2531 of the second differential wheel 253 to the least one open recess 2713 of the first folding wheel 271, or by the at least one open recess 2533 of the second differential wheel 253 to the at least one protruding portion 2711 of the first folding wheel 271, avoiding displacement of the overlapped cut pieces of fiber/plastic sheet product 22 during transfer.

The second folding wheel 273 is disposed adjacent to the first folding wheel 271, and adapted for receiving partially overlapped cut pieces of fiber/plastic sheet product 22 from the first folding wheel 271 so that the received cut pieces of fiber/plastic sheet product 22 can be set into a stack of interfold fiber sheet product.

The second folding wheel 273 comprises at least one at least one protruding portion 2731 and at least one open recess 2733 alternatively arranged around the periphery. Thus, the at least one protruding portion 2731 and at least one open recess 2733 of the second folding wheel 273 can coincide with the at least one open recess 2713 and at least one protruding portion 2711 of the first folding wheel 271 during relative rotation between the second folding wheel 273 and the first folding wheel 271, making a folding line on the fiber/plastic sheet product 22 being delivered between the first folding wheel 271 and the second folding wheel 273, and folding up the fiber/plastic sheet product 22.

In one embodiment of the present invention, the first folding wheel 271 comprises at least one suction unit 2712, and the second folding wheel 273 also comprises at least one suction unit 2732. By means of controlling the at least one suction unit 2712/2732 to suck or release the fiber/plastic sheet product 22, the fiber/plastic sheet product 22 can be folded up.

Subject to the arrangement of the at least one suction unit 232/2512/2532/2712/2732 at the rotary cutting wheel 23, first differential wheel 251, second differential wheel 253, first folding wheel 271 and second folding wheel 273 and the operation of the at least one suction unit 232/2512/2532/2712/2732 to suck or release the fiber/plastic sheet product 22, the fiber/plastic sheet product 22 can be held in place, transferred, cut, overlapped and/or folded up accurately, enhancing the operating efficiency of the fiber/plastic sheet product cutting-folding machine 20.

Figure 4C:
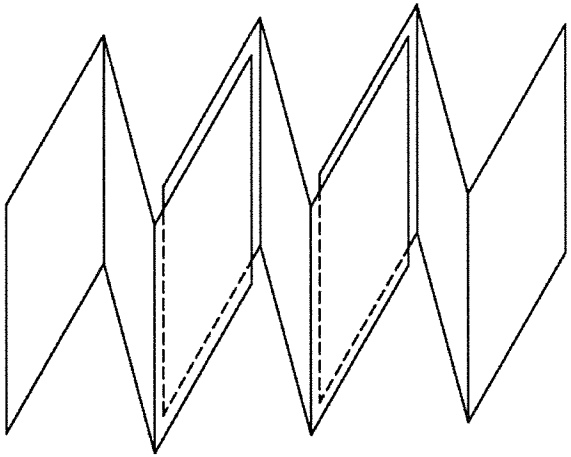

The fiber/plastic sheet product cutting-folding machine 20 of the present invention is designed for cutting and folding fiber/plastic sheet products 22, more particularly for the production of interfold fiber/plastic sheet products. It can form multiple folding lines on one single piece of fiber/plastic sheet product, and fold up the single piece of fiber/plastic sheet product into multiple folds. In the example shown in FIG. 4C, one cut piece of fiber/plastic sheet product 22 is processed to provide two folding lines and folded twice.

Figure 2D:
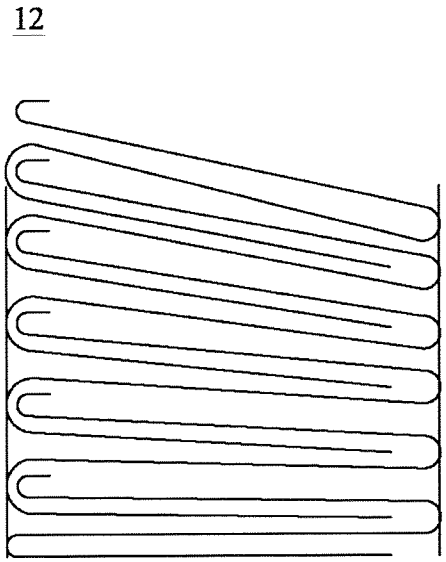
FIG.2D (PRIOR ART)
Figure 2C:
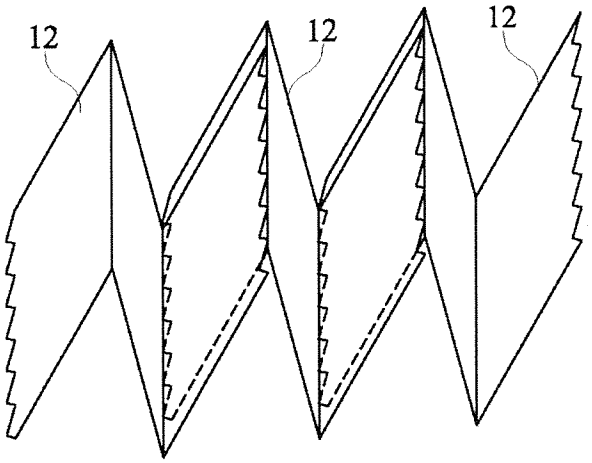
FIG.2C (PRIOR ART)

Subject to the application of the cutter 21 and the rotary cutting wheel 23, the invention avoids formation of a serrated edge on each cut piece of fiber/plastic sheet product 22 or stretching of the fiber/plastic sheet product 22 during cutting. Thus, all cut pieces of fiber/plastic sheet product 22 can have approximately the same size and length, avoiding the problem of unequal thickness of folded stack of fiber sheet product of the prior art design as shown in FIG. 2D.

Figure 4D:
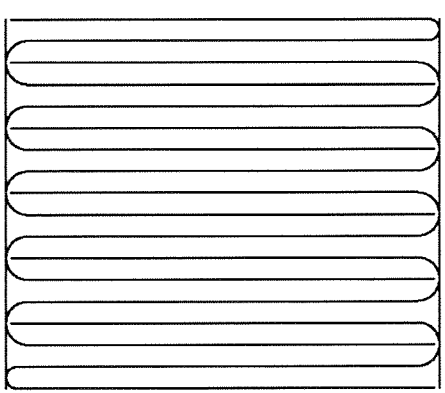

Subject to the arrangement of the at least one recessed portion 2511/2533/263/2713/2733 and/or at least one protruding portion 2531/261/2711/2731 at the first differential wheel 251, second differential wheel 253, pressure wheel 26, first folding wheel 271 and second folding wheel 273 of the fiber/plastic sheet product cutting-folding machine 20 of the present invention, displacement of the fiber/plastic sheet product 22 during transfer is prohibited, the folded stack of fiber/plastic sheet product 22 can have the same height, as shown in FIG. 4D.

It is to be understood the invention is not limited to particular systems described which may, of course, vary. It is also to be understood that the terminology used herein is for the purpose of describing particular embodiments only, and is not intended to be limiting. As used in this specification, the singular forms "a", "an" and "the" include plural referents unless the content clearly indicates otherwise. Thus, for example, reference to "a device" includes a combination of two or more devices and reference to "a material" includes mixtures of materials.

Although particular embodiments of the invention have been described in detail for purposes of illustration, various modifications and enhancements may be made without departing from the spirit and scope of the invention. Accordingly, the invention is not to be limited except as by the appended claims.

What is claimed is:

1. A fiber/plastic sheet product cutting-folding machine operable to cut and fold a predetermined fiber/plastic sheet product, comprising:

a cutter;

a rotary cutting wheel disposed adjacent to said cutter, said rotary cutting wheel including at least one cutting tool for touching said cutter to cut off said fiber/plastic sheet product during rotation of said rotary cutting wheel relative to said cutter, wherein said cutter and said at least one cutting tool each have an unserrated cutting edge; said at least one cutting tool protruding over a periphery of said rotary cutting wheel;

first and second differential wheels, wherein said first differential wheel is disposed adjacent to said rotary cutting wheel for receiving each cut piece of said fiber/plastic sheet product from said rotary cutting wheel and said second differential wheel having a circumference being less than a circumference of said first differential wheel and being disposed adjacent to said first differential wheel, wherein a rotational speed of said first differential wheel is greater than a rotational speed of said second differential wheel to thereby enable two successive cut pieces of said fiber/plastic sheet product to be partially overlapped relative to each other; wherein said first differential wheel includes at least one open recess adapted for receiving said at least one cutting tool of said rotary cutting wheel during relative rotation between said first differential wheel and said rotary cutting wheel; and wherein said second differential wheel includes at least one protruding portion coinciding with the at least one open recess of the first differential wheel during relative rotation of the second differential wheel and the first differential wheel, facilitating smooth transfer of the cut piece of fiber/plastic sheet product by the first differential wheel to the second differential wheel, and a suction unit provided at each protruding portion of the second differential wheel;

a first folding wheel disposed adjacent to said second differential wheel for receiving each cut piece of said fiber/plastic sheet product from said second differential wheel, said second differential wheel being disposed between said first differential wheel and said first folding wheel; and a second folding wheel disposed adjacent to said first folding wheel and rotatable relative to said first folding wheel to fold each cut piece of said fiber/plastic sheet product between said first folding wheel and said second folding wheel.

2. The fiber/plastic sheet product cutting-folding machine as claimed in claim 1, wherein said first differential wheel and said second differential wheel are so arranged that each two successive cut pieces of said fiber/plastic sheet product are partially overlapped at said second differential wheel.

3. The fiber/plastic sheet product cutting-folding machine as claimed in claim 1, further comprising a pressure wheel disposed adjacent to said second differential wheel and adapted to impart a pressure to each cut piece of said fiber/plastic sheet product at said second differential wheel.

4. The fiber/plastic sheet product cutting-folding machine as claimed in claim 3, wherein said second differential wheel and said pressure wheel each include at least one protruding portion and at least one open recess disposed at the periphery thereof, the at least one protruding portion and at least one open recess of said second differential wheel being moved to coincide with the at least one open recess and at least one protruding portion of said pressure wheel to make at least one folding line on each cut piece of said fiber/plastic sheet product at said second differential wheel during relative rotation between said second differential wheel and said pressure wheel.

5. The fiber/plastic sheet product cutting-folding machine as claimed in claim 1, wherein said rotary cutting wheel, said first differential wheel, said second differential wheel, said first folding wheel and said second folding wheel each include at least one suction unit controllable to suck or release each cut piece of said fiber/plastic sheet product.

6. The fiber/plastic sheet product cutting-folding machine as claimed in claim 1, wherein said second differential wheel, said first folding wheel and said second folding wheel each include at least one protruding portion and at least one open recess adapted for transferring each cut piece of said fiber/plastic sheet product.

* * * * *